US005490620A

United States Patent [19]

Bergqvist

[11] Patent Number: 5,490,620

[45] Date of Patent: Feb. 13, 1996

[54] CHILD-SUPPORTING SHOULDER HARNESS

[75] Inventor: Håkan Bergqvist, Beckombergavägen, Sweden

[73] Assignee: Baby Bjorn AB, Stocksund, Sweden

[21] Appl. No.: 270,534

[22] Filed: Jul. 5, 1994

Related U.S. Application Data

[63] Continuation of Ser. No. 956,767, Sep. 18, 1992, abandoned.

[30] Foreign Application Priority Data

Jan. 18, 1991 [SE] Sweden ..... 9100160

[51] Int. Cl.[6] ..... A47D 13/02

[52] U.S. Cl. ..... 224/160

[58] Field of Search ..... 224/160, 159, 224/158

[56] References Cited

U.S. PATENT DOCUMENTS

| | | | |
|---|---|---|---|
| 3,197,100 | 7/1965 | Thompson . | |
| 3,871,562 | 3/1975 | Grenier . | |
| 4,037,764 | 7/1977 | Almosnino et al. | 224/160 |
| 4,402,440 | 9/1983 | Purtzer et al. | 224/160 |
| 4,467,945 | 8/1984 | Schaapveld | 224/160 |
| 4,903,873 | 2/1990 | Poole et al. | 224/160 |
| 5,178,309 | 1/1993 | Bicheler et al. | 224/160 |
| 5,246,152 | 9/1993 | Dotseth | 224/159 |

FOREIGN PATENT DOCUMENTS

| | | | |
|---|---|---|---|
| 2140275 | 11/1984 | United Kingdom | 224/158 |
| 9216130 | 10/1992 | WIPO | 224/160 |

*Primary Examiner*—Renee S. Luebke
*Attorney, Agent, or Firm*—Keck, Mahin & Cate

[57] ABSTRACT

A child-supporting harness includes two mutually connected looped straps which extend around both shoulder regions of the wearer, and a child-supporting flap. The flap is connected to the straps at the top and at the bottom region of its two sides, so as to form a child-carrying pouch. The connections between the straps and the upper part of the flap at both sides thereof can be released completely, so as to allow the whole of the flap to be dropped down and to be supported by its bottom connections with the straps. The bottom of the flap is fastened to the strap by means of releasable fasteners. The side edges of the flap are free.

13 Claims, 3 Drawing Sheets

CHILD-SUPPORTING SHOULDER HARNESS

This is a continuation application of Ser. No. 07/956,767, filed on Sep. 18, 1992 and now abandoned.

FIELD OF THE INVENTION

The invention relates to a shoulder harness of the kind which includes two mutually joined and looped straps which extend around both shoulder regions of the wearer, and a supporting flap which is joined along both sides thereof to the bottom region and to the upper region of respective looped straps such as to form a child-carrying pocket or pouch.

BACKGROUND OF THE INVENTION

Child-supporting harnesses of this kind have long been known to the art and are available in many different configurations. The present invention, however, relates particularly to that type of harness with which the arms and legs of the child supported thereby will essentially straddle the body of the wearer.

A child-supporting harness of this kind, known in practice, is constructed to support the child on the chest-side of the wearer and the harness normally includes a bag-like support which is firmly joined to two looped harness straps, one for each shoulder, over substantially the whole of its vertical extension on the rear side of the bag. The bag is provided with leg openings through which the legs of the child extend at the bottom of the bag, and the bag can be opened along one side edge thereof, so as to enable a child to be placed easily in and removed from the bag. The looped straps are provided with openable locking devices in the region where the straps are joined to the bottom part of the bag, and means are provided whereby the length of the straps can be adjusted, although in practice not while the harness is worn. This type of harness has no means whereby the two looped straps can be joined together at the back of the wearer.

This known child-supporting harness, which can be said to constitute the standpoint of techniques in relation to the present invention, is encumbered with a number of drawbacks. For example, it is difficult to transfer a sleeping child from the harness to a bed, without waking the child. Furthermore, it is difficult to place a child in the harness and to remove a child therefrom while the harness is worn by the wearer. The carrying safety of such a harness is also relatively low, since the looped straps tend to slide over the wearer's shoulders. Any strap securing device provided on the rear side of the harness between the looped straps would be difficult and troublesome to manipulate.

SUMMARY OF THE INVENTION

An object of the present invention is to provide a child-supporting shoulder harness with which the aforesaid drawbacks are eliminated, either completely or partially, so that a sleeping child can be transferred from the harness to a bed with the minimum of disturbance, while maintaining the carrying safety of the harness at a high level, and with which a child can be readily placed in and lifted from the harness while the looped straps of the harness are in position on the wearer and intact.

The inventive harness thus comprises two mutually joined looped straps which extend around both shoulder regions of the wearer, and a child-support flap which is connected at both sides thereof to the bottom region and the top region of respective straps, such as to form a child-supporting pocket, the fastening connections between the strap loops and the upper part of the support flap at both sides thereof being completely releasable so as to enable the whole of the support flap to be lowered around the fastener means which connect the flap-bottom to the straps, at least one of the looped straps being releasably fastened to the support flap, so as to enable the harness to be removed and placed in position easily, even when the straps are mutually connected on the rear side of the harness.

Because the child-supporting pocket can be opened completely by dropping the support flap and thereby completely exposing the child, there is less need to remove the whole of the harness, or conversely to put on the whole of the harness, and the carrying safety of the harness can be enhanced by mutually connecting the straps on the rear side of the wearer.

In order to make the harness more comfortable, the straps are preferably arranged to cross one another in the region where they are connected on the rear side of the harness.

According to one embodiment of the invention, at least some of the releasable fasteners of connections between the looped straps and the support flap are each formed by a strip of material or band, on the one part and a ring on the other part, wherein the band has two separate press-stud fastener components which together form a press-stud connection for securing a band-loop engaging through and around the ring, and wherein the free end of a band has a button-like means, preferably of oblong shape, which prevents or impedes unintentional withdrawal of the band through the ring. This arrangement simplifies both the establishment and the release of said connections. The button means, referred to hereinafter as a toggle, forms a handgrip which facilitates release of the press-stud connection, by pulling on the toggle. When fastening the upper part of the support flap to the looped straps, the toggle may first be inserted into the rings and the press-stud connection then established. Should a press-stud connection be released unintentionally, the coaction of the toggle with the ring will provide a backup connection which prevents complete release of the connection.

BRIEF DESCRIPTION OF THE DRAWINGS

The invention will now be described in more detail with reference to an embodiment thereof at present preferred, illustrated in the accompanying drawings, in which.

DETAILED DESCRIPTION OF THE PREFERRED EMBODIMENTS

Figure 1:
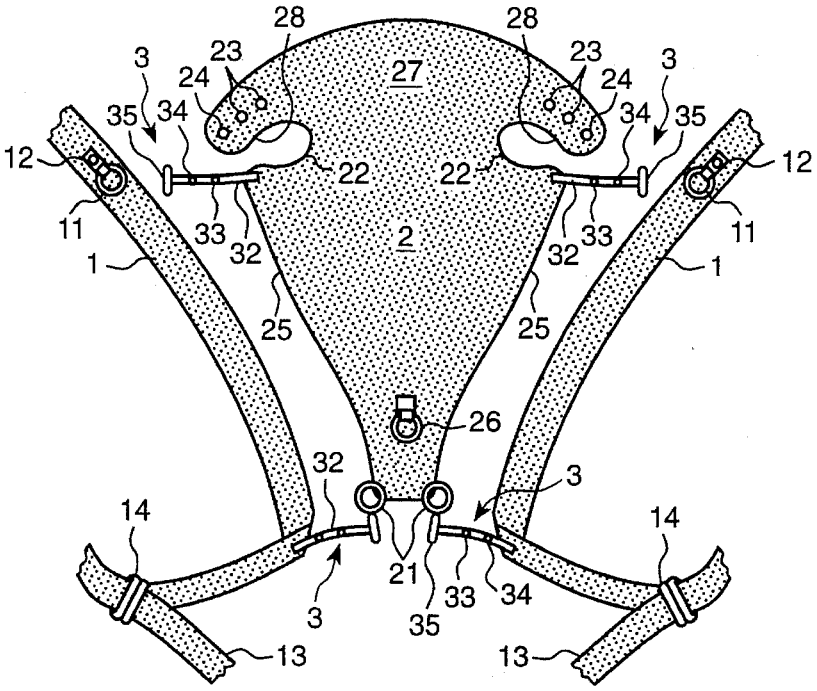
FIG. 1 illustrates schematically from above the front part of an inventive child-supporting shoulder harness, said harness being shown separated at the connections between its main components.

FIG. 1 illustrates the outwardly facing side of the inventive harness, wherein only those parts of the harness which are located on the chest side of the wearer are shown and wherein the main harness components, the looped straps 1 and the supporting flap 2, are shown separately.

Figure 2:
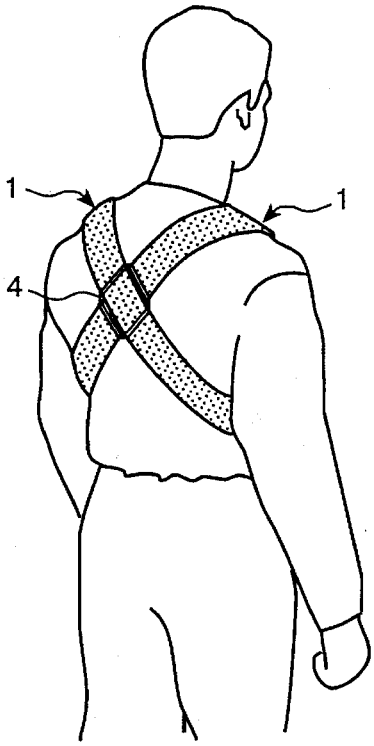
FIG. 2 illustrates the rear part of the harness when worn.

It will be seen from FIG. 2, that the looped straps 1 extend around the shoulder regions of the wearer and are mutually connected at the rear by means of a fastener connection 4.

The looped straps can be adjusted by means of a conventional adjuster 14, which enables one end 13 of the strap to be pulled so as to shorten the loop.

The supporting flap 2, the chest of the wearer and the means connecting the flap to the straps 1 define a child-carrying pocket, said supporting flap being releasably connected to the two straps 1. Provided at the bottom part of the flap 2 are two rings 21, and the looped straps l are provided with respective bands or strips 32 which have two separate press-stud elements 33, 34 capable of coacting mutually to form a press-stud fastener. Provided on the free end of the band 32 is a toggle which is connected to the band midway along its length. The extension of the toggle 35 is greater than the diameter of the ring 21. The toggle is passed through the ring 21 and the band 32 is folded back upon itself and the fastener elements 33, 34 pressed together.

A corresponding fastener element 3, comprising a band 32 having two separate press-stud elements 33, 34 and a toggle 35 at the end of said band, is provided on each side of the upper part of the supporting flap 2. The toggle is intended to coact with a ring 11 which is connected to the top of a respective looped strap.

The supporting flap 2 has free side edges 25 in the region between the fastener devices 21, 32, i.e. the side edges 25 of the flap are not connected to the straps 1.

As will be seen from FIG. 1, a central ring 26 is connected to the flap 2 at a level above the position at which the rings 21 and the ring 26 coact with the two lower fastener devices 3, so as to restrict the depth of the pocket partially defined by the supporting flap 2, in those instances when the child concerned is a small infant.

The supporting flap 2 has a neck-supporting part 27 in the region above the point at which the fastening devices are attached to the straps 1. The side edges of the flap 2 are provided with recesses 22 through which the arms of the child extend in a region immediately above the fastening devices 3. The two sides 28 of the neck-support part 27 are provided with respective fastening devices 23, 24. The attachment of the ring 11 of the strap 1 is shown to be provided with a press-stud device 12 which is able to coact with one of the press-stud devices 23, 24 to form a press-stud fastening.

Thus, in one configuration of the inventive harness, one of the fastener devices 23 can be connected to the fastener device 12 so as to stabilize the neck-support part 27 through connection with the looped straps 1.

Figure 5:
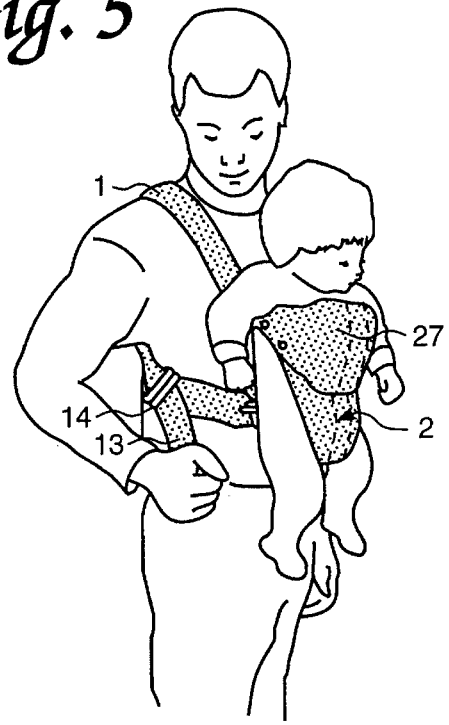
FIG. 5 illustrates a child placed in the harness facing away from the wearer.

In another configuration, used when the child is placed in the harness in a forward-facing position, as illustrated in FIG. 5, the neck-support part 27 can be folded down onto the lower part of the supporting flap 2 about a line which connects the side recesses 22, wherein the press-stud devices 24 are fastened to the press-stud devices 12, so as to hold the part 27 in its downwardly-folded position. In other cases, it is normally desirable for the supporting flap 5 to have a given degree of stiffness so as to hold the neck-supporting part 27 upright.

Figure 8:
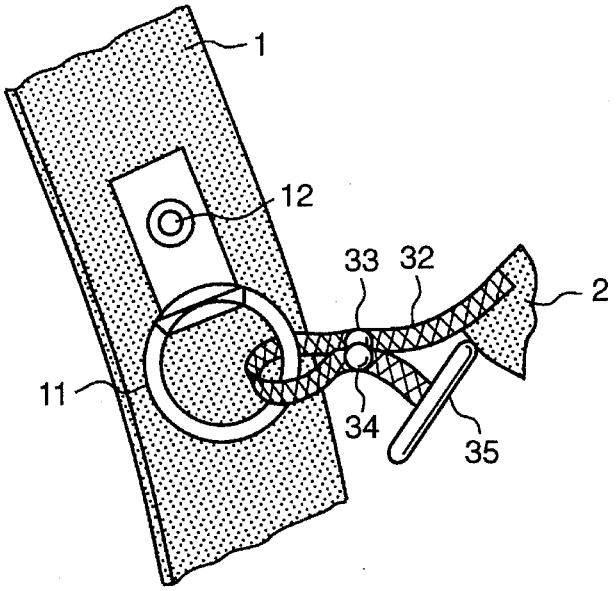
FIG. 8 is a broken view of a fully established connection between the supporting flap and one looped strap.
Figure 9:
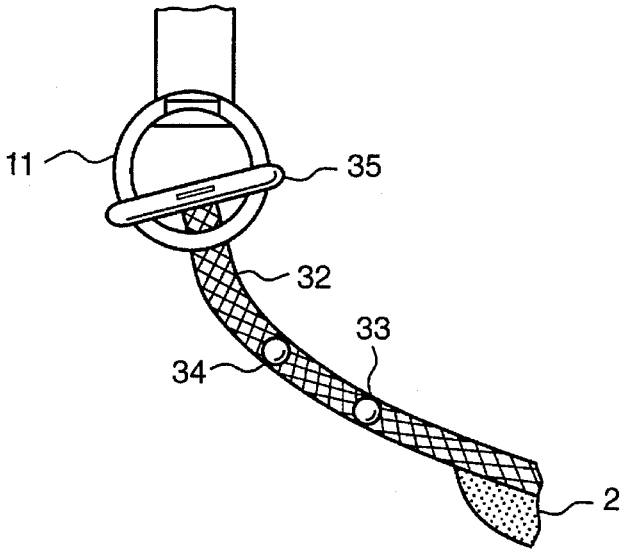
FIG. 9 is a view of a partially established connection.

As will be seen from FIG. 8, the actual connection between the band 32 and its ring, e.g. the ring 11, is established by passing the toggle 35 through the ring and pressing the press-studs 33, 34 into one another. The toggle 35 forms a handle which enables the press-stud devices 33, 34 to be readily separated, thereby facilitating release of said fastener connection. The toggle 35 also functions to prevent the connection from being fully released unintentionally, as illustrated in FIG. 9. This partially accomplished connection can also be said to constitute a primary stage in the establishment of a complete fastener connection, in which the toggle 35 is passed through its respective ring 11 in conjunction with fastening the upper part of the supporting flap 2 to its respective looped straps with a child placed in the harness, wherein the press-stud connection 33, 34 is established after fitting the toggles 35 into the rings 11.

Figure 3:
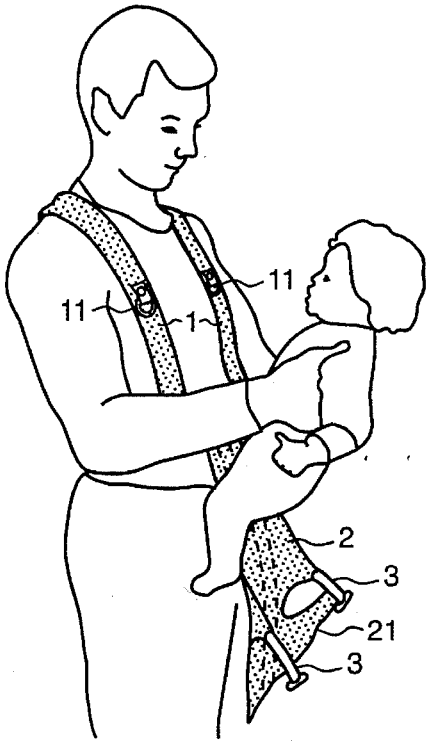
FIG. 3 illustrates schematically how a child is placed in the harness while the harness is worn.
Figure 4:
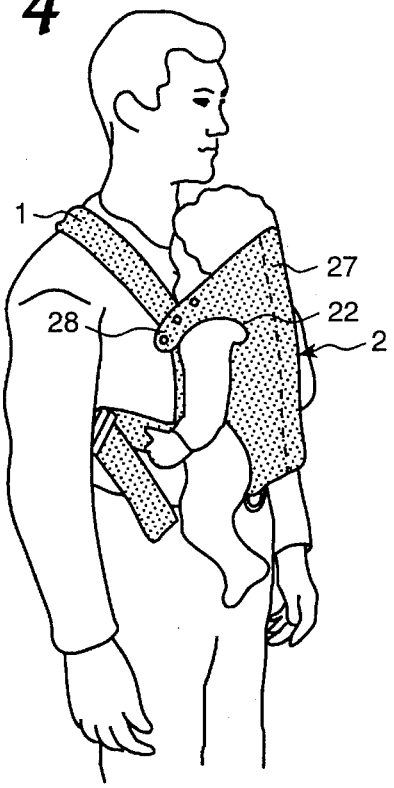
FIG. 4 illustrates a child placed in the harness facing the wearer.

As shown in FIG. 3, the supporting flap 2 can be dropped down so as to hang by its lower fastening means 3, 21; 3, 21, or lifted up around said lower fastening means, and the two upper side parts of tale flap 2 connected to the rings 1l by means of the illustrated fastener arrangement. As illustrated in FIGS. 4 and 5, the child may be seated either facing the wearer or facing away therefrom, with the neck-support part 27 of the child-supporting flap 2 either folded up or folded down, as appropriate.

Figure 6:
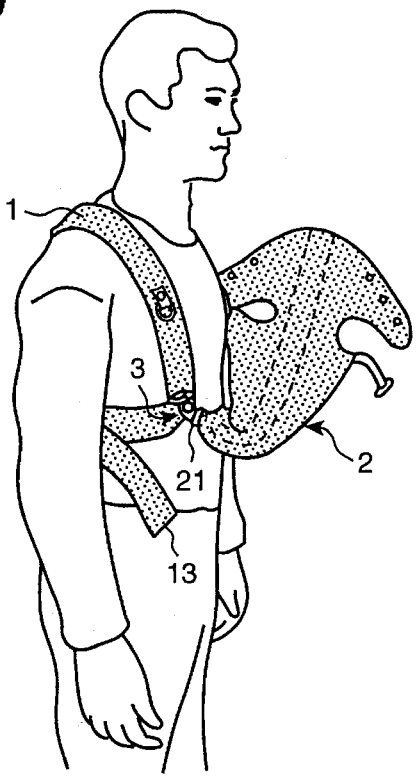
FIG. 6 illustrates the inventive harness with the supporting flap open along one side thereof.

As will be evident from FIG. 6, only one of the upper fastening connections between the flap 2 and its looped strap need be held open when placing a child into or removing a child from the harness, and consequently only one connection 3, 11 need be established in order to safely hold the child in the harness.

Figure 7:
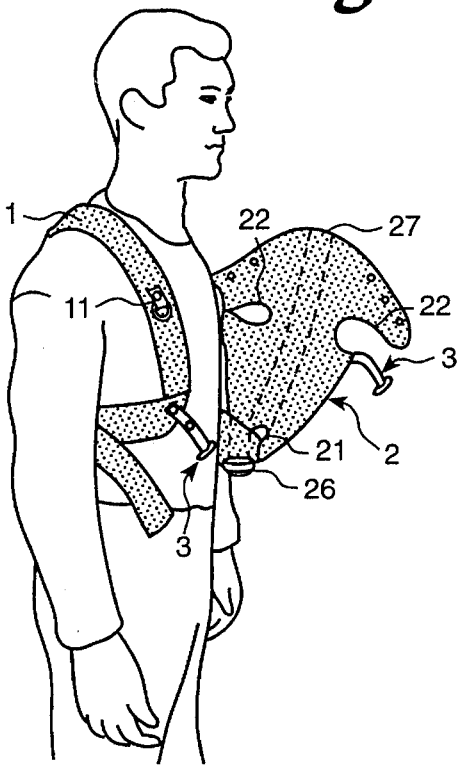
FIG. 7 illustrates the inventive harness with the looped straps mutually released on the front side of the wearer.

As shown in FIG. 7, the wearer is able to remove the whole of the harness in the manner of a jacket by also releasing the connection 3, 21 when starting from the harness state illustrated in FIG. 6.

The invention has been described in the aforegoing with reference to a preferred exemplifying embodiment thereof. It will be obvious, however, that the illustrated embodiment can be modified in many ways within the scope of the invention defined in the following Claims. For example, the bands and the rings forming the fastening connections may be switched, and the two bottom rings 21 can be replaced with a single ring 21, analogous with the ring 26, and, of course, the ring 26 can be replaced with two separate rings for coaction with a respective toggle on the bottom fastener parts 3.

The adjuster 14 is well known to the person skilled in this art and therefore does not need to be described in detail here.

I claim:

1. A child-supporting shoulder harness comprising two mutually joined looped straps (1) for extending around both shoulder regions of a wearer, and a child-supporting flap (2) having two sides each of which is releasably connected to one of the looped straps (1) both at the top and at the bottom of each of the two sides, such as to form a child-supporting pouch, wherein fastening connections (3, 11) between the looped straps (1) and an upper part of the child-supporting flap (2) at both sides thereof can be released completely so as to enable the flap to be lowered around a bottom connection (3, 21) of the flap with the straps (1), wherein connections (3, 21) between each looped strap (1) and a lower part of the flap (2) are releasable, whereby the flap can be released from the looped straps (1); and in that the looped straps (1) are mutually joined on a rear side of the harness and remain looped when putting on the harness and when the child supporting flap is released to an open position.

2. A harness according to claim 1, characterized in that edges (25) of the sides of the child-supporting flap (2) are free.

3. A harness according to claim 1, characterized in that the bottom of the flap (2) is connected to the looped straps by means of releasable fasteners (3, 21; 3, 26).

4. A harness according to claim 1, characterized in that the looped straps (1) cross on the rear side of the wearer.

5. A harness according to claim 1, characterized by adjustment means (14) provided on the looped straps in a region between a respective arm and side of the wearer, such as to enable length of the respective straps to be adjusted.

6. A harness according to claim 1, wherein the mutually joined looped straps are adjustable in length.

7. A harness according to claim 6, wherein each of said looped straps includes a free end extending downwardly located in a side for tightening the respective looped strap.

8. A child-supporting shoulder harness comprising two mutually joined looped straps (1) for extending around both shoulder regions of a wearer, a child-supporting flap (2) having two sides each of which is connected ton one of the looped straps (1) both at the top and at the bottom of each of the two sides, such as to form a child-supporting pouch, wherein fastening connections (3, 11) between the looped straps (1) and an upper part of the child-supporting flap (2) at both sides thereof can be released completely so as to enable the flap to be lowered around a bottom connection (3, 21) of the flap with the straps (1), characterized in that the connection (3, 21) between one looped strap (1) and a lower part of the flap (2) is releasable, whereby the flap can be released from one looped strap (1) so as to enable the harness to be opened on a chest side of the harness; and in that the looped straps (1) are mutually joined on the rear side of the harness and remain looped when the child supporting flap is released to an open position;

wherein edges (25) of the sides of the child-supporting flap (2) are free; and gaps defined between the free side edges of the flap (2) and respective looped straps (1) below the top connections of the flap form openings for legs of the child.

9. A child-supporting shoulder harness comprising two mutually joined looped straps (1) for extending around both shoulder regions of a wearer, a child-supporting flap (2) having two sides each of which is connected to one of the looped straps (1) both at the top and at the bottom of each of the two sides, such as to form a child-supporting pouch, wherein fastening connections (3, 11) between the looped straps (1) and an upper part of the child-supporting flap (2) at both sides thereof can be released completely so as to enable the flap to be lowered around a bottom connection (3, 21) of the flap with the straps (1), characterized in that the connection (3, 21) between one looped strap (1) and a lower part of the flap (2) is releasable, whereby the flap can be released from one looped strap (1) so as to enable the harness to be opened on a chest side of the harness; and in that the looped straps (1) are mutually joined on the rear side of the harness, wherein the bottom of the flap (2) has provided thereon vertically spaced points of connection (21, 26) with the looped straps (1), so as to enable the child-supporting pocket to be adapted to children of different sizes.

10. A child-supporting shoulder harness comprising two mutually joined looped straps (1) for extending around both shoulder regions of a wearer, a child-supporting flap (2) having two sides each of which is connected to one of the looped straps (1) both at the top and at the bottom of each of the two sides, such as to form a child-supporting pouch, wherein fastening connections (3, 11) between the looped straps (1) and an upper part of the child-supporting flap (2) at both sides thereof can be released completely so as to enable the flap to be lowered around a bottom connection (3, 21) of the flap with the straps (1), characterized in that the connection (3, 21) between one looped strap (1) and a lower part of the flap (2) is releasable, whereby the flap can be released from one looped strap (1) so as to enable the harness to be opened on a chest side of the harness; and in that the looped straps (1) are mutually joined on the rear side of the harness, wherein the releasable connections (3, 21); (3, 11) between supporting flap and the looped straps have a fastening which includes a ring (11; 21) connected to one part, a band (32) connected to another part, a free end of which is provided with a preferably elongated toggle (35) for coaction with the ring (11; 21), and in that the band (32) is provided along a length thereof with two mutually separate and mutually coacting fastener elements (33, 34) of a press-stud type, such that the strap will form a closed loop (36) through the ring.

11. A child-supporting shoulder harness comprising two mutually joined looped straps (1) for extending around both shoulder regions of a wearer, a child-supporting flap (2) having two sides each of which is connected to one of the looped straps (1) both at the top and at the bottom of the two sides, such as to form a child-supporting pouch, wherein fastening connections (3, 11) between the looped straps (1) and an upper part of the child-supporting flap (2) at both sides thereof can be released completely so as to enable the flap to be lowered around a bottom connection (3, 21) of the flap with the straps (1), characterized in that the connection (3, 21) between one looped strap (1) and a lower part of the flap (2) is releasable, whereby the flap can be released from a looped strap (1) so as to enable the harness to be opened on a chest side of the harness; and in that the looped straps (1) are mutually joined on the rear side of the harness, wherein the flap (2) includes a neck-support part (7) which extends up beyond the level of the fastening connections (3, 11) of said flap; in that the neck-support part is provided along its side (28) with fastener elements (23) for releasably fastening said neck-support part to the two looped straps (1) so as to stabilize said neck-support part (27).

12. A harness according to claim 11, characterized in that the neck-support part (27) can be folded down; and in that the looped straps (1) have fastener elements (12) for releasably fastening the straps to mutually registering fastener elements (24) on the neck-support part, such as to releasably hold the neck support in its downwardly-folded position.

13. A harness according to claim 11, characterized in that the child-supporting flap (2) has lateral recesses (22) for accommodating arms of the child.

* * * * *